United States Patent [19]

Groshong

[11] Patent Number: 4,598,516

[45] Date of Patent: Jul. 8, 1986

[54] CEILING FINISH JOINT FOR DRY WALL PARTITIONS AND METHOD OF MAKING SAME

[76] Inventor: Frank E. Groshong, R.R. 3, Paola, Kans. 66071

[21] Appl. No.: 707,183

[22] Filed: Mar. 1, 1985

Related U.S. Application Data

[63] Continuation of Ser. No. 416,990, Sep. 13, 1982, abandoned.

[51] Int. Cl.[4] ..... E04B 2/74

[52] U.S. Cl. ..... 52/241; 52/287; 52/417

[58] Field of Search ..... 52/241, 287, 417, 259, 52/288, 254, 255, 256, 257, 278, 353, 354, 355, 357, 358, 359, 360, 74, 238, 239

[56] References Cited

U.S. PATENT DOCUMENTS

| | | | |
|---|---|---|---|
| 1,475,409 | 11/1923 | Riddle | 52/241 |
| 1,595,673 | 8/1926 | Magney | 52/356 |
| 2,234,701 | 3/1941 | Lyman | 52/417 |
| 2,257,712 | 9/1941 | Crandell | 52/241 |
| 2,268,710 | 1/1942 | Lewke | 52/241 |
| 2,843,889 | 7/1958 | Keller | 52/287 |
| 2,884,779 | 5/1959 | Buergin | 52/241 |
| 3,370,390 | 2/1968 | Livermore | 52/287 |
| 3,408,250 | 10/1968 | Finefrock | 52/288 |
| 3,606,714 | 9/1971 | Arnett | 52/288 |
| 3,726,051 | 4/1973 | Kellis | 52/11 |

*Primary Examiner*—John E. Murtagh

*Attorney, Agent, or Firm*—Schmidt, Johnson, Hovey & Williams

[57] ABSTRACT

A neat, finish quality trim joint is prepared between an upstanding dry wall partition and the ceiling to conceal a gap and ragged upper edge of the partition left during erection of the partition. An elongated, inverted, transversely L-shaped member of the joint is secured to the face of the partition along the upper marginal edge thereof in such a manner that the vertically extending leg of the member covers the gap while its other, horizontally extending leg lies up against the ceiling and projects outwardly from the partition generally into the roomspace. With the member secured in this manner, the finisher spreads a layer of mortar over the vertical leg and adjacent portions of the partition in order to provide a smooth transition from the partition to the member and to fully conceal the vertical leg. In applying the mortar, the finisher may advantageously run the edge of his trowel along and abutted against the horizontal leg which protectively masks the ceiling at this time. Therefore, the mortar may be applied quickly, smoothly and evenly without smearing or discoloring the protected ceiling surface.

5 Claims, 14 Drawing Figures

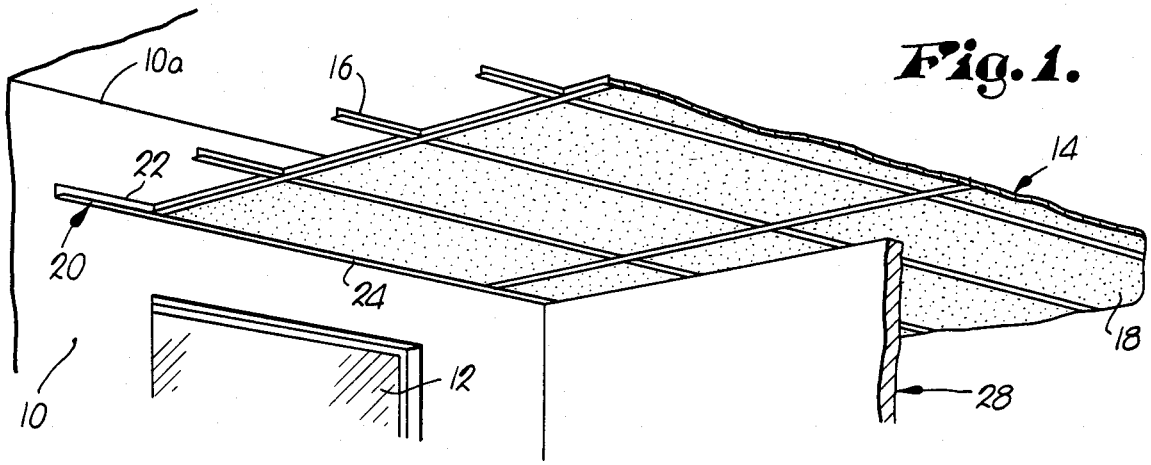
Fig. 1.
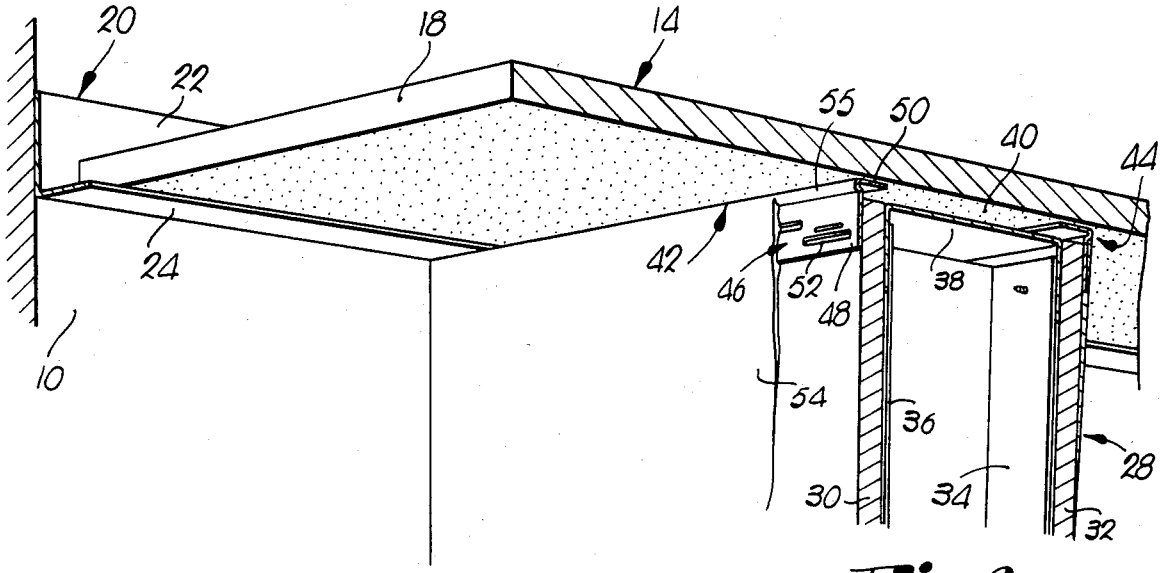
Fig. 2.
PRIOR ART
Fig. 3. PRIOR ART
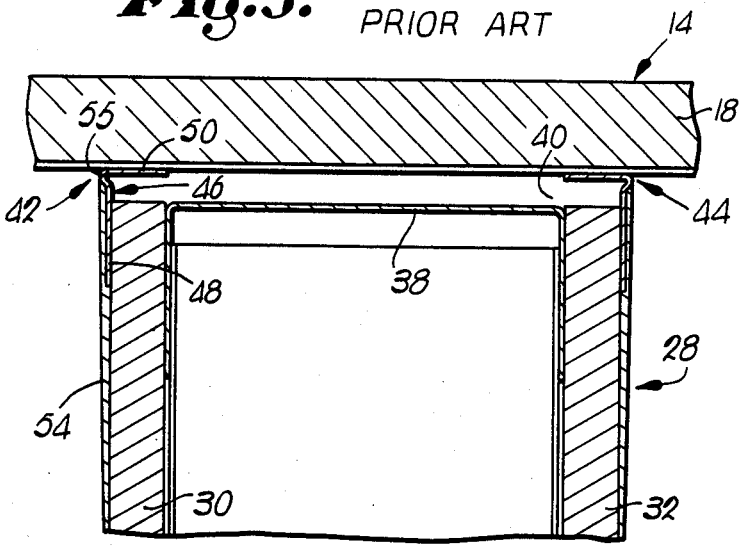
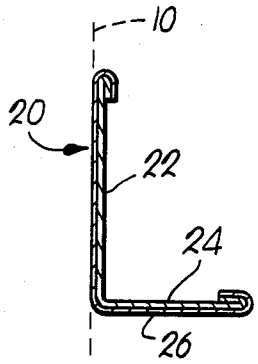
Fig. 4.
PRIOR ART

CEILING FINISH JOINT FOR DRY WALL PARTITIONS AND METHOD OF MAKING SAME

This application is a continuation, of application Ser. No. 06/416,990, filed 9/13/82.

TECHNICAL FIELD

This invention relates to the field of building construction and, more particularly, to that stage in the erection of interior wall partitions within a building structure where plasterers or finishers prepare smooth joints between dry wall sections and the ceiling.

BACKGROUND ART

It is a common practice in the preparation of commercial office space and the like in new building structures to present the new tenant with a bare "slab" floor and "exterior" walls which bound or describe a relatively large expanse of area which the tenant can then subdivide in a way he chooses. Normally, a ceiling grid covering the entire empty floor space to be subsequently partitioned off is installed between the exterior walls of the space prior to the time that the space is then subsequently partitioned off into smaller roomspaces. Typically, the ceiling grid includes rectangular sections of tile which are supported in a suitable lattice work and which can be dislodged and removed or replaced as may be necessary to gain access to the area above the ceiling grid normally used for heating and cooling conduits, electrical lines and the like.

The ceiling grid is peripherally supported by the exterior wall using a component commonly referred to as a "ceiling angle". The angle is generally transversely L-shaped, having a vertical leg which lies along the exterior wall and a horizontal leg or lip which projects outwardly from the wall into the slab space and carries the grid.

The vertical location of the lip is carefully determined and is normally only partially up the height of the exterior walls.

When the interior partitions are then erected, the common practice is to use sections of dry wall material that are somewhat shorter than the ceiling height to thereby leave a small gap between the upper marginal edge of the partitions and the ceiling. Present practice is to thereafter conceal the gap with a piece of trim or molding material known as "L-bead" in such a way that, after being inverted, the transversely L-shaped bead is essentially "hooked over" the upper edge of the partition. In such position the bead is butted up against the underside of the ceiling and is thereupon lightly secured in place on the face of the partition by stapling or the like. Thereafter, the finisher applies a layer of mortar over the L-bead where it lies against the face of the partition so that the L-bead will be fully concealed and the mortar will provide a more suitable, uniform surface for receiving paint or other wall treatment.

It is in the application of mortar to the L-bead, however, that problems can and do arise. First, the mortar is difficult to control perfectly, even by the most skilled finisher. Thus, unless the finisher exercises extreme, painstaking care as he trowels on the mortar, some of it will slip up onto the white ceiling tile and result in an unsightliness that is quite objectionable. Moreover, once the mortar has adhered to the porous, rough surface of the ceiling tile, it is extremely difficult to eradicate and restore the tile to its original, pristine condition.

Therefore, one commonly used technique is for the finisher to loosen the tiles from their supporting grid and to temporarily raise them up away from the underlying L-bead to provide a margin of error for the mortar application. This is an extremely awkward, laborious and time-consuming process, however, and requires the finisher to either somehow raise each tile section with one hand as he attempts to apply mortar with the other hand, or to prop up the tile sections in advance with pieces of scrap lumber or the like which he can scavenge at the construction site. Once the mortar has cured, the finisher must then take the time to remove the props from the raised tile pieces and to properly reset them in place. Obviously, devoting this much time to propping up the tiles, setting them back in place, and then cleaning them off if a mistake is made, makes the current dry wall finishing practice extremely expensive, compared to its cost if those extra steps were not necessary.

SUMMARY OF THE PRESENT INVENTION

Accordingly, it is one important object of the present invention to provide a way of drastically reducing the time, effort and expense associated with preparing ceiling joints in the present customary manner while at the same time producing an end product that provides a neater, cleaner more finished trim appearance for the joint than has heretofore been available.

Pursuant to the foregoing, the present invention contemplates applying a special inverted, transversely L-shaped molding member to the face of the partition along the upper marginal edge thereof in such a manner that a vertical leg or strip of the member covers over and conceals the gap between the partition and the ceiling while a second, horizontally extending leg or strip of the member lies up against the ceiling tile and projects outwardly away from the partition generally toward the roomspace being bounded by the partition. After the member is stapled or otherwise secured to the partition, the finisher spreads a layer of mortar along the vertical leg of the member and adjacent portions of the partition in order to cover and conceal the same, and while doing so he runs the edge of his trowel against and along the leg of the member protectively masking the ceiling. Thus, the mortar is evenly and smoothly applied while the ceiling is effectively shielded by the horizontal leg of the member, to prevent accidental application of mortar to the ceiling tile. Moreover, once the joint is finished, the ceiling is left with a neat, trim border which may advantageously match the exposed lip of the ceiling angle along the exterior walls. A variety of useful features may be provided within the member itself including, for example, a special interior rib along the intersection between the two leg or strip portions of the member to provide a raised surface for the trowel during the spreading strokes by the finisher and in order to thereby promote the desired "feathering" of the mortar onto the face of the partition; a finish coat of paint or the like on the downwardly facing inside surface of the member matching the exposed lip of the ceiling angle; a removable pull-tape or the like protectively covering the exposed, downwardly facing surface of the horizontal leg of the member which may be removed after the mortar application has been completed; and an adhesive film along the back surface of the vertical leg of the member for use in adhering the member to the face of the partition as it awaits the application of the mortar thereto.

BRIEF DESCRIPTION OF THE DRAWINGS

FIG. 1 is a fragmentary perspective view of a typical prior art construction utilizing an exterior wall, a ceiling grid and a dry wall partition;

FIG. 2 is an enlarged perspective view thereof;

FIG. 3 is a still further enlarged, fragmentary, vertical cross-sectional view through the prior art ceiling and dry wall partition construction;

FIG. 4 is an enlarged, transverse cross-sectional view of a ceiling support angle used in conjunction with the construction of FIGS. 1–3;

DETAILED DESCRIPTION

Figure 11:
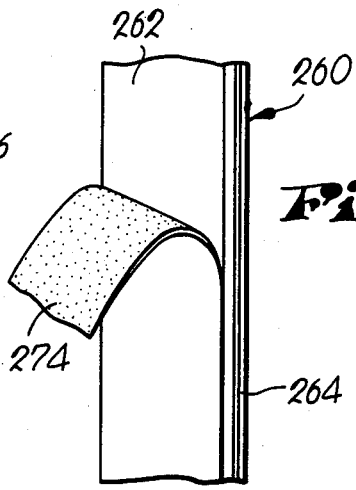
FIG. 11 is a fragmentary plan view illustrating the manner in which the pull-tape on the embodiment of FIG. 10 may be easily removed.

FIG. 11 illustrates a typical prior art construction for a commercial roomspace or the like. The numeral 10 is used to indicate what will hereinafter be referred to as an exterior wall, which is one that is normally erected and prepared at the time the slab space is initially constructed, generally long prior to subdividing the area into individual roomspaces through partitions. The numeral 12 represents a window in such exterior wall 10.

At the time the exterior wall 10 is erected, a ceiling 14 is also prepared and installed consisting of a lattice 16 or grid and a series of individual tile sections 18 supported within the lattice 16. The ceiling 14 is peripherally supported at a point below the upper edge 10*a* of exterior wall 10 by a ceiling angle 20 which is strategically positioned in order to locate the ceiling 14 at the specified height such as, for example, eight feet. As illustrated for example in FIGS. 2 and 4, the ceiling angle 20 is generally transversely L-shaped, having a flat, vertical portion 22 that lies flatly against the wall 10 and a flat horizontally outwardly projecting portion or lip 24. The vertical portion 22 is fixedly secured to the exterior wall 10 so as to transfer weight from the ceiling 14 to the wall 10 via the supporting lip 24 upon which the ceiling 14 rests. As illustrated in an exaggerated manner in FIG. 4, the ceiling angle 20 has a coating of paint 26 along its back side which butts up against the wall 10 and along the exposed lower surface of the lip 24. Thus, in an installation, the exposed lower surface of the lip 24 presents a trim border around the ceiling 14 at the junction of the latter with the exterior wall 10.

FIGS. 2 and 3 illustrate the nature of the prior ceiling joints. A partition broadly denoted by the numeral 28 with which such a joint is associated includes a pair of upright sheets of dry wall material 30 and 32 horizontally spaced apart and secured to internal, channel-shaped framing studs such as the upright stud surfaces 34 and 36 and the upper horizontal channel surface 38. The partition 28 terminates slightly below the ceiling 18 so as to present a gap 40 which extends longitudinally along the top of the partition 28 between the latter and the ceiling 18. Such gap 40 is closed by a pair of joints 42 and 44 on opposite sides of the partition 28, such joints 42 and 44 being identical to one another.

Using the joint 42 as an example, it will be seen that an elongated member 46 of inverted, transversely L-shaped configuration comprises the principal component thereof, such member 46 having a vertical leg 48 and a horizontal leg 50 integrally joined with the vertical leg 48. The member 46 is turned in such a way that the horizontal leg 50 is essentially hooked over the top edge of sheet 30, although the leg 50 is butted up against the ceiling tile 18 rather than placed down onto and against the top edge of the sheet 30. Thus, the vertical leg 48 covers over and conceals the gap 40. Staples or other suitable fasteners can be applied to the leg 48 across the various slits 52 or other perforations therein in order to secure the member 46 to the sheet 30. A layer of mortar 54 covers over the stapled leg 48 in order to conceal the same and to provide a smooth transition between the surface of sheet 30 and the lower edge extremity of the member 46. A longitudinally extending rib 56 on the outside of the member 46 at the intersection of legs 48 and 50 thereof is provided to support a portion of the trowel used by the finisher so as to promote a buildup of mortar 54 on top of the leg 48 but then permit the mortar 54 to be feathered out as it is spread over the face of sheet 30 below the member 46.

Figure 5:
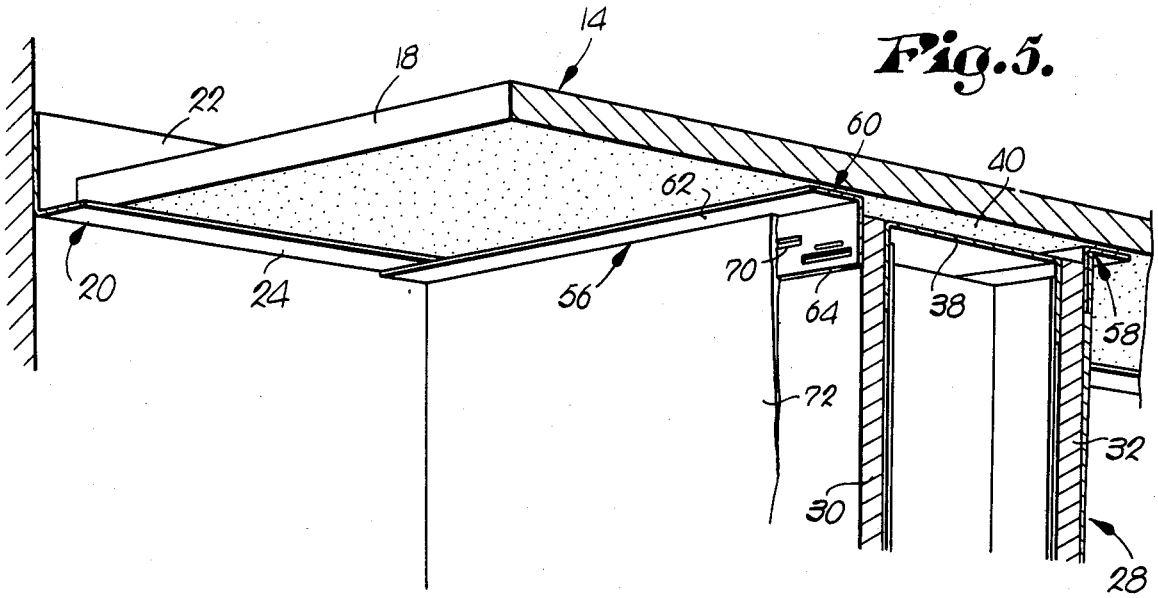
FIG. 5 is a fragmentary perspective view in partial cross-section of a ceiling finished joint constructed in accordance with the principles of the present invention.
Figure 6:
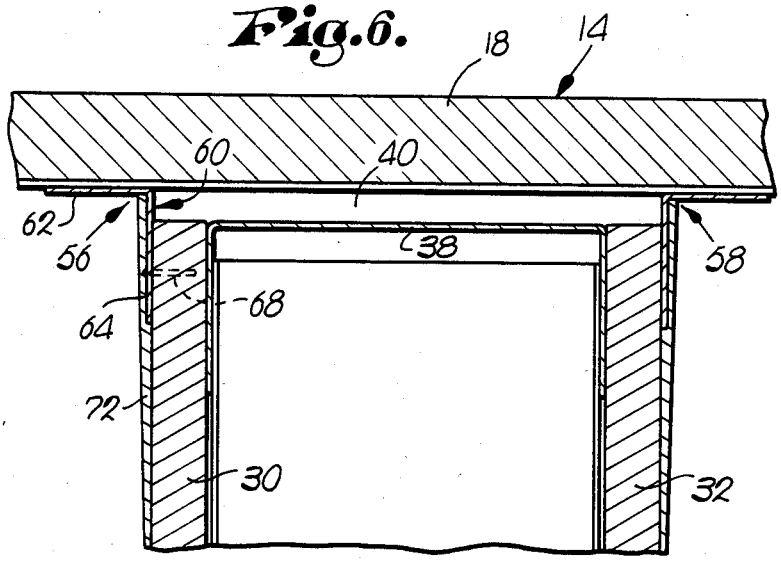
FIG. 6 is an enlarged, vertical cross-sectional view thereof revealing details of construction.
Figure 7:
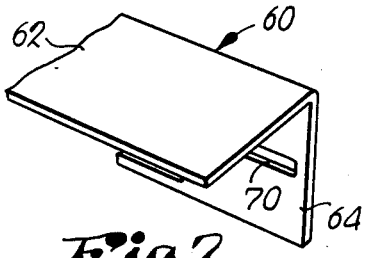
FIG. 7 is a front perspective view of a mold member used in connection with constructing the ceiling joint of the present invention in accordance with FIGS. 5 and 6.
Figure 8:
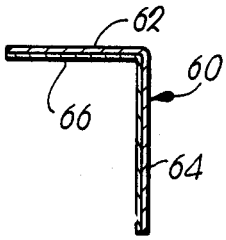
FIG. 8 is a transverse cross-sectional view thereof.

FIGS. 5, 6, 7 and 8 illustrate a construction wherein a ceiling joint in accordance with the principles of the present invention is utilized instead of the prior art joint 42 as illustrated in FIGS. 1–4. The exterior wall 10 and ceiling angle 20, ceiling tiles 18, partition 28 and gap 40 are still present, but two new joints denoted broadly by the numerals 56 and 58 are utilized in lieu of the joints 42 and 44. Using the joint 56 as an example, it will be seen that the primary component of such joint is an elongated trim or molding member 60 of inverted transversely L-shaped configuration. Such member 60 has a pair of integrally interconnected strips or legs 62 and 64 joined at substantially right angles to one another. As illustrated in FIG. 8, the interior surface of the member 60 with respect to the included angle defined by the legs 62 and 64 is provided with a decorative coating 66 of paint or the like. Preferably, the leg 62 is of the same width as the leg 24 of the ceiling angle 20.

As illustrated, the leg 62 is butted up against the lower surface of the ceiling 14 and extends along the partition 28 to one side of the latter, i.e. on the roomspace side thereof as opposed to the interior partition side as is the case with the leg 50 of the prior art joint 42. The leg 62 underlies the leg 24 of ceiling angle 20 in the corner of a roomspace as illustrated for example in FIG. 5.

With the leg 62 engaged against the ceiling 14, the vertical leg 64 is disposed to span the gap 40 and thereby cover and conceal the same. Staples 68 or the like (as shown in phantom in FIG. 6) may be secured across a series of slits 70 or other perforations in the leg 64 in order to fasten the member 60 to the outer face of the sheet 30 in the appropriate manner. A layer 72 of mortar completely covers the leg 64 in order to conceal the same and to provide a smooth transition between the face of the sheet 30 and the lower edge extremity of the member 60.

Figure 12:
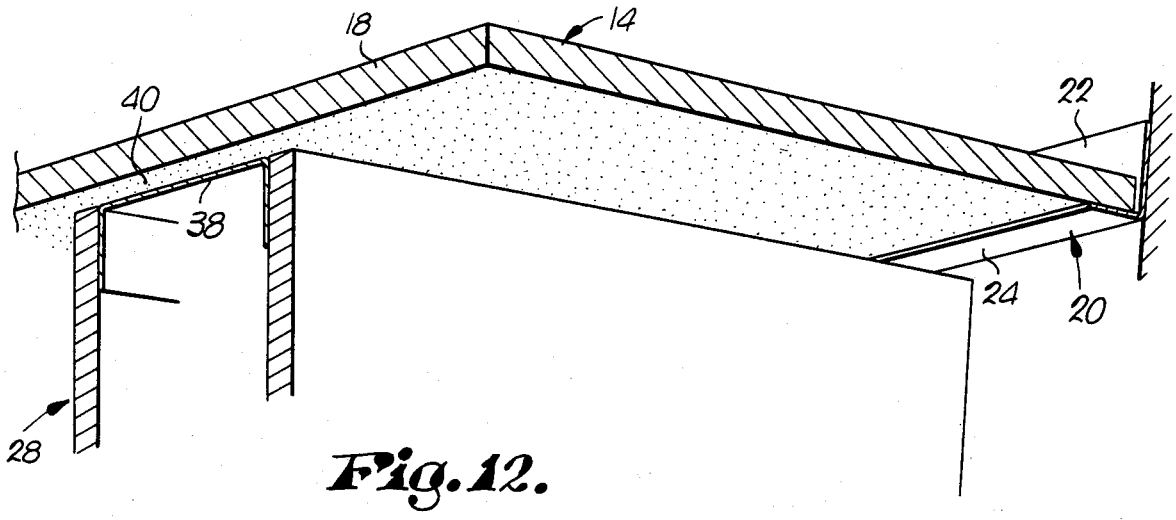
FIGS. 12, 13 and 14 are fragmentary perspective views, partially in cross-section, representing successive steps in a novel method of preparing the special ceiling finished joint of the present invention.
Figure 13:
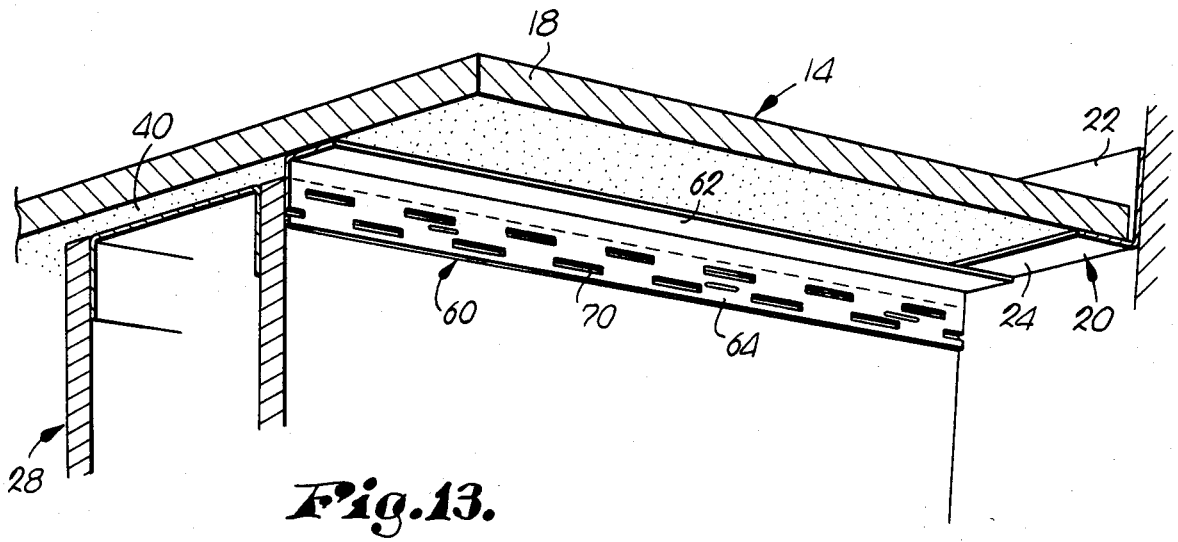
Figure 14:
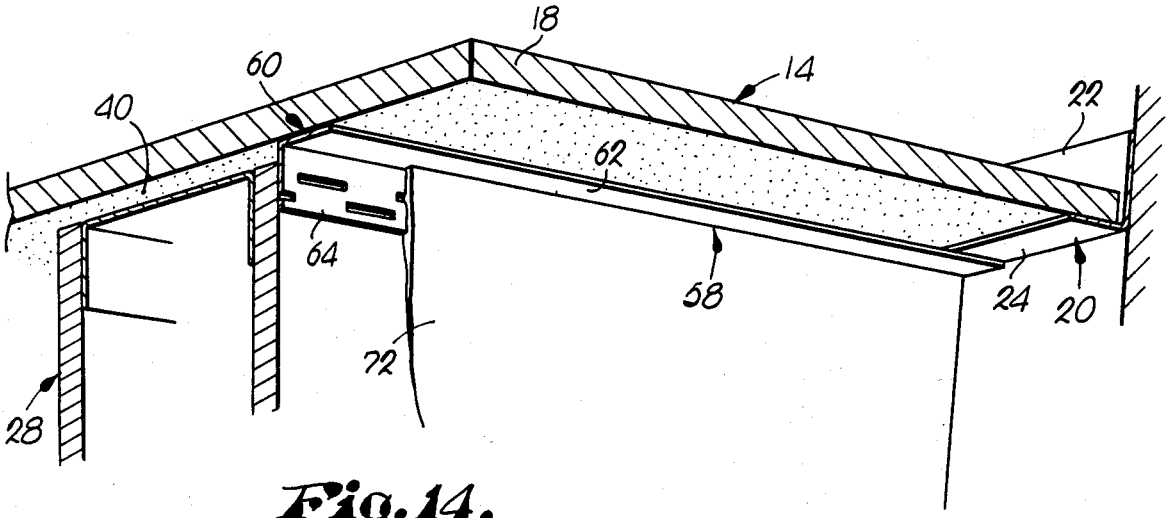

FIGS. 12, 13 and 14 illustrate sequential steps in the method of preparing a joint 56 or 58 in accordance with the present invention. As illustrated in FIG. 12, the partition 28 is initially erected in the usual manner, leaving the gap 40 between the bottom surface of the ceiling 14 and the upper marginal edge of the partition 28.

Then, as illustrated in FIG. 13, the special member 60 is stapled or otherwise secured to the face of the partition 28 in such a way that the leg 62 of member 60 projects outwardly away from the partition 28 and into the roomspace at the same time that it butts up against the underside of the ceiling 14. Thus, the leg 64 of member 60 completely covers and conceals the gap 40.

Next, as shown in FIG. 14, the layer 72 of mortar is applied in convering relationship to leg 64 so as to completely conceal the latter. In this connection, application of the layer 72 is quickly, easily and neatly carried out by the finisher as it is only necessary for the finisher to apply the mortar in a smooth sweeping stroke along the leg 64 with the edge of his trowel butted up against and running along the horizontal leg 62. Thus, the leg 62 not only serves to mask the ceiling 14 during this operation and thus prevent the accidental spreading of mortar onto that surface, but also serves as a gauge or guide for locating and positioning the trowel as the spreading stroke is carried out. After the mortar layer 72 has dried, any selected type of wall finish may be applied such as, for example, paint, fabric or wallpaper.

It will be appreciated that as a result of having the leg 62 of member 60 exposed after the joint has been completely fabricated, and with the paint coating 66 applied, the leg 62 may serve as an attractive border around the ceiling 14 which matches the border effect provided by the leg 24 of ceiling angle 20. Consequently, it may be seen that the present invention not only provides an extremely effective labor-saving benefit, but also an attractive way of trimming the ceiling to enhance the aesthetic qualities of the roomspace.

Figure 9:
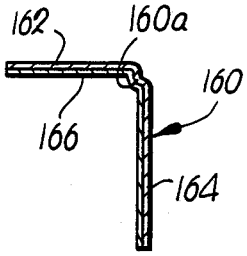
FIG. 9 is a transverse cross-sectional view of a second embodiment of the mold member incorporating a trowel-guiding rib as an integral part thereof.

FIG. 9 shows an alternative embodiment. In this respect, the member 160 therein illustrated is identical to the member 60 of FIG. 8, except for the provision of a rib **160*a* which extends longitudinally of the member on the inside surface thereof at the intersection of legs 162 and 164. The paint coating 166 shown in exaggerated form is also utilized in this embodiment on the interior surface thereof. The rib 160*a* provides a type of guide for the finisher as he applies the mortar layer to cover the leg 164. In this respect, as the finisher presses the flat side of the trowel against the rib 160*a*, the trowel will necessarily be cocked slightly so as to provide for a thicker buildup of mortar in the area of the leg 164** than in the area of the adjacent partition face against which the trowel is also engaged.

Figure 10:
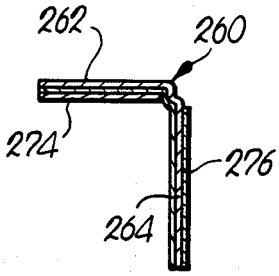
FIG. 10 is a transverse cross-sectional view of a third embodiment of the mold member, this embodiment including the use of a protective pull-ribbon or tape along the downwardly facing decoratively coated surface of the member, and alternatively, an adhesive composition along the back side of the member for adhering the same to the dry wall partition during the installation.

FIGS. 10 and 11 illustrate another embodiment of the mold member in accordance with the present invention. In this respect, the member 260 is quite similar to the member 160 except that a protective ribbon or tape 274 may be provided on the otherwise exposed, painted surface of the leg 262. Then, after the mortar has been applied to the leg 264, the tape 274 may be peeled off as illustrated in FIG. 11 to provide a clean, clear surface that is completely devoid of any possible smears or smudges of mortar. If desired, the member 260 may also be provided with a layer of adhesive composition shown in exaggerated form and denoted by the numeral 276. Such layer 276 may be used to bond the member 260 to the partition in lieu of staples if desired. As a convenience, the layer 276 may be normally covered by a suitable tape or strip (not shown) which is then peeled off to expose the adhesive when the member 260 is to be applied to the partition.

It is to be emphasized that the finish joint of the present invention provides a final touch to a room that produces a pleasing, aesthetically complete environment. The present practice of simply having the rough accoustical ceiling tile butt directly against the inturned L-bead produces a half finished, incomplete look that is not in keeping with decorative wall treatments and attractive furniture that might be used in the roomspace. By using a finish coat of paint on the exposed leg of the finish joint of the present invention which closely matches the exposed finish coat of paint on the ceiling angle, a neat, trim, completed look is achieved with matching borders to the ceiling all around its periphery.

It is also to be noted that the finish joint of the present invention is believed to contribute significantly to sound containment. In this respect, the conventional construction, with the leg of the L-bead projecting away from the roomspace, has no means of deflecting sound back into the roomspace as it attempts to move over the L-bead along the space between the same and the accoustical tile.

In the present invention, however, errant sound waves directed toward the ceiling joint cannot reach the crevice immediately above the partition along the ceiling tile because the sound is intercepted by the outwardly facing angle of the finish joint and directed back into the room. Thus, sounds which might otherwise escape from the room are contained in a manner not heretofor available.

Of particular importance is the manner in which the finish joint of the present invention helps prevent the joint from accidentally popping loose during the application of mortar thereto. In this respect, it will be appreciated that a significant amount of pressure is applied to the joint by the finisher as he spreads mortar with the trowel. In view of the fact that the finish member projects up above the top extremity of the partition a considerable distance, the application of spreading force by the trowel has a tendency to apply leverage against the staples or other means of bonding the member to the wall such that those articles are encouraged to pop loose from the wallboard material from which the partition is normally constructed. Even in the event that the staples themselves do not totally pop loose, any movement of the member during the application of the mortar thereto by the trowel tends to crack the slightly dried mortar in an area of previous application, thereby requiring the finisher to retrace his steps and apply mortar once again to the previous area. Manifestly, this can be not only quite frustrating, but extremely wasteful in terms of manhours and materials.

In the case of the present invention, however, the upper leg of the finish joint bears directly against the overhead ceiling. Consequently, any force applied to the "overhanging" portion of the member above the upper extremity of the partition is absorbed and taken up by the ceiling itself as the upper leg tends to rock upwardly against the ceiling. Thus, there is no tendency for the staples or other fasteners to be popped loose, to the end that the finisher can apply substantial pressure as may be necessary or desirable during the mortar spreading stroke. The delicate, cautious action necessary in connection with prior constructions can be completely avoided.

I claim:

1. A ceiling finish joint comprising:

an upright partition having an upper horizontally extending marginal edge and a vertical face below said edge;

a ceiling extending horizontally above said partition and having a downwardly facing, lower, finished surface spaced above said edge along the length of the latter to present a longitudinally extending gap;

molding having at least a portion thereof provided with an inverted, generally transversely L-shaped configuration both when the molding is detached from the partition prior to forming a part of the joint and after attachment to the partition, said molding having a first elongated, flat leg lying flatly against and secured to said face of the partition with its longitudinal axis extending generally parallel to said edge, said first leg spanning said gap and having an upper lateral extremity disposed upwardly beyond said edge, said molding further having a second elongated, exposed flat leg butted flatly against and without attachment to said surface of the ceiling beside said partition with its longitudinal axis extending generally parallel to said edge, said second leg having an outer lateral extremity spaced outwardly from said face of the partition and an inner lateral extremity integrally connected with said upper extremity of the first leg; and a layer of mortar covering only said first leg and overlapping a portion of said face of the partition below said first leg in a manner to provide a smooth, undetectable transition from the partition to the first leg along the lower extremity of the latter and to leave said second leg exposed as a finished border along the ceiling.

2. A ceiling finish joint as claimed in claim 1, wherein said second leg has an exposed, decorative coating between said lateral extremities thereof.

3. A ceiling finish joint as claimed in claim 2, wherein said decorative coating is provided with a removably adhered, protective ribbon covering the same.

4. A ceiling finish joint as claimed in claim 1, wherein said integrally joined extremities of the legs are provided with a longitudinally extending rib therebetween, said rib projecting transversely inwardly with respect to the included angle defined between said legs.

5. A method of preparing a finish joint between a ceiling having a downwardly facing, finished surface and an upright partition having an upper marginal edge spaced a short distance below said ceiling to present a gap, said method including the steps of:

providing a length of molding having at least a portion thereof provided with an inverted, generally transversely L-shaped configuration;

securing said molding to the face of said partition along said marginal edge in a manner to conceal the gap with one vertically extending leg of the L-shaped portion of the molding, said securing step including positioning the molding with the other leg of the L-shaped portion of the molding projecting horizontally outwardly away from the partition and butted up against the ceiling so that the included angle defined between said legs faces into the roomspace bounded by said partition;

spreading a layer of mortar over only said vertical leg of the molding and proximal face of said partition in a manner to conceal said vertical leg and provide a smooth transition between the partition and the vertical leg along the lower extremity of the latter;

while said spreading step is being carried out, masking the finished surface of the ceiling with said horizontal leg of the molding whereby to facilitate the spreading step; and after completing said spreading step, leaving said other leg of the molding in place and visually exposed whereby to present a finished border along the ceiling.

* * * * *